US007071155B2

(12) United States Patent
Griese et al.

(10) Patent No.: US 7,071,155 B2
(45) Date of Patent: Jul. 4, 2006

(54) NON-POLYMER THICKENING AGENT AND CLEANING COMPOSITION

(75) Inventors: Greg G. Griese, Hudson, WI (US); Mike J. Bartelme, Eden Prairie, MN (US); Victor Fuk-Pong Man, Saint Paul, MN (US); Ed D. Sowle, Woodbury, MN (US)

(73) Assignee: Eoclab, Inc., Eagan, MN (US)

( * ) Notice: Subject to any disclaimer, the term of this patent is extended or adjusted under 35 U.S.C. 154(b) by 359 days.

(21) Appl. No.: 10/263,414

(22) Filed: Oct. 2, 2002

(65) Prior Publication Data

US 2004/0067866 A1 Apr. 8, 2004

(51) Int. Cl.
*C11D 1/12* (2006.01)

(52) U.S. Cl. ..... 510/426; 510/424; 510/505; 510/506

(58) Field of Classification Search ..... 510/365, 510/506, 505, 417, 245, 238, 212, 191, 434, 510/504, 423; C23G 5/02; C11D 9/00, C11D 7/50
See application file for complete search history.

(56) References Cited

U.S. PATENT DOCUMENTS

| | | | | |
|---|---|---|---|---|
| 4,457,322 | A * | 7/1984 | Rubin et al. | 134/2 |
| 4,758,377 | A | 7/1988 | Iding | |
| 5,011,621 | A * | 4/1991 | Sullivan | 510/211 |
| 5,080,822 | A | 1/1992 | VanEenam | |
| 5,080,831 | A | 1/1992 | VanEenam | |
| 5,158,710 | A * | 10/1992 | VanEenam | 510/264 |
| 5,342,551 | A | 8/1994 | Ruckle | |
| 5,364,551 | A * | 11/1994 | Lentsch et al. | 510/100 |
| 5,419,848 | A | 5/1995 | VanEenam | |
| 5,490,948 | A * | 2/1996 | Klier et al. | 510/283 |
| 5,585,341 | A * | 12/1996 | Van Eenam | 510/365 |
| 5,597,793 | A | 1/1997 | Besse et al. | |
| 5,783,538 | A | 7/1998 | Totoki | |
| 5,854,187 | A | 12/1998 | Blum et al. | |
| 5,900,048 | A * | 5/1999 | Olson et al. | 106/2 |
| 5,948,742 | A * | 9/1999 | Chang et al. | 510/191 |
| 5,977,042 | A * | 11/1999 | Hernandez et al. | 510/201 |
| 6,221,823 | B1 * | 4/2001 | Crisanti et al. | 510/238 |
| 6,228,832 | B1 | 5/2001 | Kinscherf et al. | |
| 2002/0077267 | A1 | 6/2002 | Parry et al. | |
| 2002/0104169 | A1 | 8/2002 | Sivik et al. | |

FOREIGN PATENT DOCUMENTS

| | | |
|---|---|---|
| DE | 3916628 | 11/1990 |
| FR | 2 593 187 | 7/1987 |
| GB | 1 471 886 | 4/1977 |
| JP | 6116594 | 4/1994 |
| WO | WO 98/55587 | 12/1998 |
| WO | WO 01/21719 | 3/2001 |

OTHER PUBLICATIONS

DOW Products Literature, "Glycol Ethers Nomenclature", Found and printed off of the internet prior to the filing date of Oct. 2, 2002.
DOW Products Literature, "Chemistry of Dowanol Glycol Ether Products", found and printed off of the internet prior to the filing date of Oct. 2, 2002.
DOW Products Literature, "Solveat HLB and OHLB Values for DOWANOL Oxygenated Solvents", found and printed off of the Internet prior to the filing date of Oct. 2, 2002.

* cited by examiner

*Primary Examiner*—Gregory Webb
(74) *Attorney, Agent, or Firm*—Crompton, Seager & Tufte, LLC

(57) ABSTRACT

A non-polymer thickening medium, and the inclusion of such a non-polymer thickening medium in a cleaning composition. In some embodiments, the non-polymer thickening medium includes a sparingly water soluble surfactant, and an organic solvent including an OH group, an ether group, or both an OH group and an ether group. At lease some of the two components of the thickening medium interact with each other thicken a composition to which they are added. In some embodiments, the thickening medium components are included within a cleaning composition which further includes a source of alkalinity, and a polar carrier. Some other embodiments relate to methods of making, and methods of using such thickening medium and cleaning compositions.

28 Claims, No Drawings

NON-POLYMER THICKENING AGENT AND CLEANING COMPOSITION

FIELD OF THE INVENTION

The invention relates to thickening medium and cleaning compositions and, more particularly, to a non-polymer thickening medium, and a cleaning composition that includes such non-polymer thickening medium.

BACKGROUND

Many cleaner/degreaser compositions are presently used in many applications, such as retail, industrial and institutional applications. In many such compositions, a polymer thickening agent is included to impart a level of viscosity to the composition, and therefore provide for increased contact time on surfaces to be cleaned. However, due to the presence of the polymer thickening agent within such cleaning compositions, it is believed that the cleaning action of at least some of the active cleaning components within the composition is reduced with a consequent and marked reduction in the cleaning/degreasing action required for effective cleaning and oily soilant removal. While not wishing to be held to any theory as to the nature of the cleaning and degreasing action of presently available compositions, it is believed that the polymer thickener may act as a barrier, and slows down the diffusion of at least some of the active cleaning ingredients, thereby reducing contact with the soil. Additionally, it is believed that the polymer thickener may act to dilute the active cleaning agents within the cleaning composition, thereby reducing the cleaning effectiveness.

There remains a need, therefore, for cleaning compositions with cleaning and degreasing capabilities where the composition has the desired viscosity for sufficient contact time, but without the other deficiencies of some of the presently available cleaner/degreaser compositions.

SUMMARY OF SOME EMBODIMENTS

Some embodiments of the invention relate to a non-polymer thickening medium, and the inclusion of such a non-polymer thickening medium in a cleaning composition. In some embodiments, the non-polymer thickening medium includes a sparingly water soluble surfactant, and an organic solvent including an OH group, an ether group, or both an OH group and an ether group. At lease some of the two components of the thickening medium interact with each other thicken a composition to which they are added. In some embodiments, the thickening medium components are included within a cleaning composition which further includes a source of alkalinity, and a polar carrier. Some other embodiments relate to methods of making, and methods of using such thickening medium and cleaning compositions.

DETAILED DESCRIPTION OF SOME EMBODIMENTS

DEFINITIONS

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

Weight percent, percent by weight, % by weight, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

The term "alkyl" refers to a straight or branched chain monovalent hydrocarbon radical having a specified number of carbon atoms. Alkyl groups may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halo, for example. Examples of "alkyl" include, but are not limited to, methyl, ethyl, n-propyl, isopropyl, n-butyl, s-butyl, t-butyl, n-pentyl, n-hexyl, 3-methylpentyl, and the like.

The term "alkoxy" refers to refers to a straight or branched chain monovalent hydrocarbon radical having a specified number of carbon atoms and a carbon-oxygen-carbon bond, may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halo, for example. Examples include, methoxy, ethoxy, propoxy, t-butoxy, and the like.

The term "alkenyl" or "alkenylene" refers to a straight or branched chain divalent hydrocarbon radical having a specified number of carbon atoms and one or more carbon—carbon double bonds. Alkenylene groups may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halo, for example. Examples of "alkenyl" or "alkenylene" include, but are not limited to, ethene-1,2-diyl, propene-1,3-diyl, and the like.

The term "cycloalkyl" refers to an alicyclic hydrocarbon group having a specified number of carbon atoms. Cycloalkyl groups include those with one to twelve carbon atoms. Cycloalkyl groups may be saturated or unsaturated, unsubstituted or substituted with those substituents that do not interfere with the specified function of the composition. Cycloalkyl may be substituted by halo, $C_1$–$C_6$ alkyl, $C_1$–$C_6$ alkoxy, $C_2$–$C_6$ alkenyl, substituted $C_1$–$C_6$ alkyl, $C_1$–$C_6$ substituted alkoxy, substituted $C_2$–$C_6$ alkenyl, substituted alkoxy, amino, nitro, cyano, carboxy, hydroxymethyl, aminomethyl, carboxymethyl, $C_1$–$C_4$ alkylthio, hydroxy, $C_1$–$C_4$ alkanoyloxy, carbamoyl, or halo-substituted $C_1$–$C_6$ alkyl and may be substituted once or more with the same or different group. Such a cycloalkyl ring may be optionally fused to one or more of another heteroaryl ring(s), aryl ring(s), or cycloalkyl rings. Examples of "cycloalkyl" include, but are not limited to, cyclopropyl, cyclobutyl, cyclopentyl, cyclohexyl, cycloheptyl, or cyclooctyl, and the like.

The term "heterocyclic" or "heterocyclyl" refers to a monovalent three to twelve-membered non-aromatic ring containing one or more heteroatomic substitutions independently selected from S, O, or N and having zero to five degrees of unsaturation. Heterocyclyl groups may be unsubstituted or substituted with those substituents that do not interfere with the specified function of the composition. Heterocyclyl may be substituted by halo, $C_1$–$C_6$ alkyl, $C_1$–$C_6$ alkoxy, $C_2$–$C_6$ alkenyl, substituted $C_1$–$C_6$ alkyl, $C_1$–$C_6$ substituted alkoxy, substituted $C_2$–$C_6$ alkenyl, substituted alkoxy, amino, nitro, cyano, carboxy, hydroxymethyl, aminomethyl, carboxymethyl, $C_1$–$C_4$ alkylthio, hydroxy, $C_1$–$C_4$ alkanoyloxy, carbamoyl, or halo-substituted $C_1$–$C_6$ alkyl and may be substituted once or more with the same or different group. Such a heterocyclic ring may be optionally fused to one or more of another heterocyclic ring(s), heteroaryl ring(s), aryl ring(s), or cycloalkyl rings. Examples of "heterocyclic" include, but are not limited to, tetrahydrofuryl, pyranyl, 1,4-dioxanyl, 1,3-dioxanyl, piperidinyl, pyrrolidinyl, morpholinyl, tetrahydrothiopyranyl, tetrahydrothiophenyl, and the like.

The term "aryl" refers to monovalent unsaturated aromatic carbocyclic radicals having a single ring, such as phenyl, or multiple condensed rings, such as naphthyl or anthryl. Aryl groups may be unsubstituted or substituted with those substituents that do not interfere with the specified function of the composition. Aryl may be substituted by halo, $C_1$–$C_6$ alkyl, $C_1$–$C_6$ alkoxy, $C_2$–$C_6$ alkenyl, substituted $C_1$–$C_6$ alkyl, $C_1$–$C_6$ substituted alkoxy, substituted $C_2$–$C_6$ alkenyl, substituted alkoxy, amino, nitro, cyano, carboxy, hydroxymethyl, aminomethyl, carboxymethyl, $C_1$–$C_4$ alkylthio, hydroxy, $C_1$–$C_4$ alkanoyloxy, carbamoyl, or halo-substituted $C_1$–$C_6$ alkyl and may be substituted once or more with the same or different group. Such an aryl ring may be optionally fused to one or more of another heterocyclic ring(s), heteroaryl ring(s), aryl ring(s), or cycloalkyl rings. Examples of "aryl" include, but are not limited to, phenyl, 2-naphthyl, 1-naphthyl, biphenyl, 2-hydroxyphenyl, 2-aminophenyl, 2-methoxyphenyl and the like.

The term "heteroaryl" refers to a monovalent five to seven membered aromatic ring radical containing one or more heteroatoms independently selected from S, O, or N. Heteroaryl groups may be unsubstituted or substituted with those substituents that do not interfere with the specified function of the composition. Heteroaryl may be substituted by halo, $C_1$–$C_6$ alkyl, $C_1$–$C_6$ alkoxy, $C_2$–$C_6$ alkenyl, substituted $C_1$–$C_6$ alkyl, $C_1$–$C_6$ substituted alkoxy, substituted $C_2$–$C_6$ alkenyl, substituted alkoxy, amino, nitro, cyano, carboxy, hydroxymethyl, aminomethyl, carboxymethyl, $C_1$–$C_4$ alkylthio, hydroxy, $C_1$–$C_4$ alkanoyloxy, carbamoyl, or halo-substituted $C_1$–$C_6$ alkyl and may be substituted once or more with the same or different group. Such a "heteroaryl" ring may be optionally fused to one or more of another heterocyclic ring(s), heteroaryl ring(s), aryl ring(s), or cycloalkyl rings. Examples of "heteroaryl" include, but are not limited to, furyl, thiophenyl, pyrrolyl, imidazolyl, pyrazolyl, triazolyl, tetrazolyl, thiazolyl, oxazolyl, isoxazolyl, oxadiazolyl, thiadiazolyl, isothiazolyl, pyridinyl, pyridazinyl, pyrazinyl, pyrimidinyl, quinolinyl, isoquinolinyl, benzofuryl, benzothiophenyl, indolyl, and indazolyl, and the like.

The term "halo" and "halogen" refer to chloro, bromo, fluoro, and iodo.

COMPOSITIONS

In at least some embodiments, the invention relates to a cleaning composition including: (a) a non-polymer thickening medium including: (i) a sparingly water soluble surfactant, and (ii) an organic solvent containing an OH group, an ether group, or both an OH group and an ether group; (b) a source of alkalinity; and (c) a polar carrier.

Non-Polymer Thickening Medium

As indicated above, the non-polymer thickening medium for use in cleaning compositions includes: (a) a sparingly water soluble surfactant; and (b) an organic solvent containing an OH group, an ether group, or both an OH group and an ether group. While not wishing to be held to any theory as to the nature and activity of the non-polymer thickening medium, it is believed that in at least some embodiments, when these components are included in a cleaning composition, such as an aqueous based cleaning composition, at least some of the sparingly water soluble surfactant and at least some of the organic solvent interact with each other to thicken the composition. For example, it is hypothesized that the interaction between the sparingly water soluble surfactant and the organic solvent may include hydrogen bonding, such as long range hydrogen bonding, that acts to increase the viscosity of the composition. Regardless of how exactly the thickening mechanism or interaction between these components takes place, the thickening activity has been observed, as can be seen in the examples set fourth below.

Another aspect of at least some embodiments of such non-polymer thickening medium is the increased cleaning activity that has been observed relative to similar compositions that are thickened using polymer thickeners. Again, not wishing to be held to any theory as to the nature of the cleaning and degreasing action of such compositions, it is believed that when the non-polymer thickening medium is included in some embodiments of a cleaning composition, the diffusion of at least some of the active cleaning ingredients is improved relative to compositions using polymer thickeners, thereby increasing contact of the active cleaning ingredients with the soil. It is believed that the non-polymer thickening medium does not create as much of a barrier to diffusion as polymer thickeners.

Additionally, in at least some embodiments, the individual components of the non-polymer thickening medium are believed to have at least some cleaning and/or degreasing action, while traditional polymer thickeners generally do not have substantial cleaning and/or degreasing action. Traditional polymer thickeners tend to dilute the active cleaning ingredients, and therefore decrease the overall cleaning and/or degreasing action of the composition. Therefore, the inclusion of non-polymer thickening medium being made up of components having at least some cleaning and/or degreasing action can increase the cleaning and/or degreasing action of the composition.

The sparingly water soluble surfactant and the organic solvent components are present in the non-polymer thickening medium, or in the cleaning composition as a whole, in amounts and ratios relative to one another to provide the desired level of thickening. In some example embodiments, the weight percent ratio of the sparingly water soluble surfactant component to the organic solvent component is in the range of about 5:1 to about 1:5, in the range of about 3:1 to about 1:3, or in the range of about 2:1 to about 1:2. Some examples of suitable sparingly water soluble surfactant and the organic solvent components are discussed below.

Sparingly Water Soluble Surfactant

Suitable sparingly soluble surfactants include those that interact with the organic solvent component to provide the desired level of thickening within a particular thickening medium or cleaning composition. In at least some embodiments, the sparingly water soluble surfactant has a water solubility in the range of about 0.001 to about 30, in the range of about 0.01 to about 25, or in the range of about 0.1 to about 15 weight percent in water. It will be understood by those of skill in the art and others that the above ranges of solubility are based primarily upon solubility in relatively pure water, and that in compositions including other components, for example cleaning compositions including additional functional ingredients, these solubility ranges may change due to the effect of other components within the composition. For example, the solubility ranges may be lower due to the effect of other electrolytes within the composition.

In at least some embodiments, the sparingly water soluble surfactant comprises an anionic surfactant, however, it is contemplated that other surfactants, such as nonionic, semi-polar nonionic, cationic, amphoteric, or zwitterionic surface-active agents; or any combination thereof, may be used, provided they interact with the organic solvent component to provide the desired level of thickening within a particular thickening medium or cleaning composition.

In some embodiments, suitable sparingly water soluble surfactants include anionic surfactants having a sulfonate group. Some examples of such surfactants include linear or branched, substituted or unsubstituted alkyl benzene sulfonates, or derivatives thereof. In some such embodiments, the linear or branched alkyl portion of the linear alkyl benzene sulfonate includes in the range of 4 and 18 carbon atoms.

In at least some embodiments, the alkyl benzene sulfonate includes a cationic portion. The cationic portion typically includes a suitable cationic moiety suitable for the particular alkyl benzene sulfonate. For example, the cationic moiety can include an alkali metal ion, an alkali earth metal ion, an ammonium ion, a protonated amine ion, or a protonated alkanolamine ion.

For example, in some embodiments, the sparingly water soluble surfactant can include a compound of the formula:

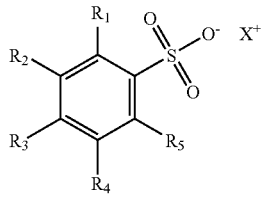

wherein $R_1$–$R_5$ are the same or different, and are each independently hydrogen, or $C_1$ through $C_{18}$ linear or branched, unsubstituted or substituted alkyl; and $X^+$ is a cation. In some embodiments, $R_1$, $R_2$, $R_4$, and $R_5$ can be hydrogen, and $C_3$ can be a linear or branched, unsubstituted or substituted alkyl having in the range of 1 and 18 carbon atoms. Some particular examples of such surfactants include linear dodecyl benzene sulfonic acid, isopropylamine dodecyl benzene sulfonate, or the like, or combinations, mixtures, or derivatives thereof.

The amount of sparingly soluble surfactant included within a particular cleaning composition can be dependent upon the desired level of thickening, which in turn can also be dependent upon the amount of organic solvent component within the composition. In at least some embodiments, the sparingly water soluble surfactant may be present in the range of about 0.5 to about 20%, or about 1 to about 15%, or 5 to about 12% by weight based on the total weight of a particular cleaning composition. It should be understood that these ranges can vary, depending upon the desired level of thickening, and the corresponding amount of organic solvent component within any particular composition.

Organic Solvent

Suitable organic solvents include those that interact with the sparingly soluble surfactant component to provide the desired level of thickening within a particular thickening medium or cleaning composition. Typically, the organic solvent includes an OH group, an ether group, or both an OH group and an ether group. While not wishing to be held to any theory as to the nature and activity of the non-polymer thickening medium, it is believed that an OH group, an ether group, or both an OH group and an ether group of the organic solvent interact with the sparingly soluble surfactant to provide thickening of a composition.

In at least some embodiments, the organic solvent may be at least moderately soluble in aqueous solutions. One measure of solubility is known as hydrophilic-lipophilic balance (HLB), and another measure of solubility is organic hydrophilic-lipophilic balance (OHLB).

The hydrophilic-lipophilic balance organic hydrophilic-lipophilic balance scales are described by Dow Chemical Company at www.dow.com technical brochure entitled "Solvent HLB and OHLB Values for Dowanol Oxygenated solvents", that is incorporated by reference herein. HLB is generally useful for predicting a solvent's solubility in water. An HLB value less than 7 indicates that the solvent is generally hydrophobic. The HLB scale was derived initially for surfactants and provides a means for comparing the relative hydrophilicity of amphiphilic molecules. HLB values are also relevant for solvents, such as glycol ethers and the like. Substantially complete water solubility occurs at an HLB of around 7. Solvents with HLB values above this mark are generally completely miscible in water, while those below this value are generally only partially soluble in water. The HLB scale is useful for visualizing the ease of compatiblizing solvents into water.

The OHLB scale is generally useful for predicting a solvent's partitioning characteristics. The OHLB trends are opposite that of the HLB scale. In addition, the scale refers to a slightly different property, referring to how a solvent will partition in a multiphase aqueous system. The higher the solvent OHLB value the greater is its tendency to partition into the organic phase. The lower the solvent OHLB value, the greater its tendency to partition into the aqueous phase.

The organic solvent component of the thickening medium may have a hydrophilic-lipophilic balance (HLB) value in the range of about 5 to 8, and in some embodiments, in the range of about 7 to about 8. The organic solvent may also have an OHLB value in the range of about 12 to about 20, or in some embodiments, in the range of about 14 to about 18.

Again, the solubility within any given solution may change due to other species in the solution. For example, the solubility in water may change due to other electrolytes present in the water solution. It should be understood by those of skill in the art and others that the above ranges of solubility characteristics are based primarily upon solubility in relatively pure water.

Some examples of suitable organic solvents include glycol ethers, such as propylene glycol ethers or ethylene glycol ethers. Some particular examples of such compounds include: propylene glycol phenyl ether (i.e., 1-phenoxy-2-propanol), ethylene glycol phenyl ether (i.e., 2-phenoxyethanol), tri propylene glycol-n-butyl ether (i.e., (2-(2-butoxymethylethoxy)methylethoxy)-propanol), di propylene glycol-n-butyl ether (i.e., 1-(2-butoxy-1-methylethoxy)-2-propanol), propylene glycol-n-butyl ether (i.e., 1-butoxy-2-propanol), tri propylene glycol-n-propyl ether (i.e., 1-(1 or 3-methyl-2-(methyl(-2-propoxyethoxy) ethoxyl-propanol), di propylene glycol-n-propyl ether (i.e., 1-(1-methyl-2-proproxyethyoxy)-2-propanol), propylene glycol-n-propyl ether (i.e., 1-propoxy-2-propanol), ethylene glycol-n-butyl ether (i.e.,2-butoxy-ethanol), di ethylene glycol-n-butyl ether (i.e., 2-(2-butoxy-ethoxy)-ethanol, or the like, or mixtures or derivatives thereof. At least some of these listed solvents are commercially available under Dowanol, Cellosolve, or Dalpad tradenames from Dow Chemical Company.

Additional solvents that are at least partly immiscible in water include, for example, benzyl alcohol, 2-phenoxyethanol, and the like, or a derivative, combination, or mixtures thereof. These solvents are commercially available from Aldrich Chemical Company.

As will be apparent to those skilled in the art, the above-listed solvents are merely illustrative and various other solvents meeting the criteria set out above may also be used in the practice of the invention.

The amount of organic solvent included within a particular cleaning composition can be dependent upon the desired level of thickening, which in turn can also be dependent upon the amount of sparingly soluble surfactant component within the composition. In at least some embodiments, the organic solvent may be present in cleaning compositions in the range of about 1 to about 20%, or about 1 to about 15%, or 5 to about 12% by weight based on the total weight of a particular cleaning composition. It should be understood that these ranges can vary, depending upon the desired level of thickening, and the corresponding amount of sparingly soluble surfactant component within any particular composition.

Alkalinity Source

An alkalinity source may be provided to enhance cleaning of a substrate, improve soil removal, to increase the pH of the composition, or to perform other functions. The source of alkalinity can include any alkalinity producing material that is generally compatible with other components within the given composition. Some examples of sources of alkalinity include alkali metal salts, alkali earth metal salts, ammoniums, protonated amines, protonated alkanol amines, or the like, and combinations or mixtures thereof.

These sources of alkalinity may be present in cleaning compositions in the range of about 0.5 wt-% to about 90 wt-%, about 0.5 wt-% to about 50 wt-%, or about 1 to about 40 wt-% of the total composition.

Polar Carrier

The cleaning compositions of the invention may include a polar carrier media, such as water, alcohols, for example low molecular weight primary or secondary alcohols exemplified by methanol, ethanol, propanol, isopropanol, and the like, or other polar solvents, or mixtures and combinations thereof.

Polar carrier may be present in the composition in the range of about 10 to about 90%, in the range of about 20 to about 80%, or in the range of about 25 to 75% by weight based on the total weight of the composition.

Additional Materials

The compositions may also include additional materials, such as additional functional materials, for example enzymes, enzyme stabilizing system, additional surfactant, chelating agents, sequestering agents, bleaching agents, additional thickening agent, solubility modifier, detergent filler, defoamer, anti-redeposition agent, a threshold agent or system, aesthetic enhancing agent (i.e. dye, perfume, ect.) and the like, or combinations or mixtures thereof. Adjuvants and other additive ingredients will vary according to the type of composition being manufactured and can be included in the compositions in any amount. The following is a brief discussion of some examples of such additional materials.

Enzymes

The composition of the invention may includes one or more enzymes, which can provide desirable activity for removal of protein-based, carbohydrate-based, or triglyceride-based stains from substrates; for cleaning, destaining, and sanitizing presoaks, such as presoaks for flatware, cups and bowls, and pots and pans; presoaks for medical and dental instruments; or presoaks for meat cutting equipment;

for machine warewashing; for laundry and textile cleaning and destaining; for carpet cleaning and destaining; for cleaning-in-place and destaining-in-place; for cleaning and destaining food processing surfaces and equipment; for drain cleaning; presoaks for cleaning; and the like. Enzymes may act by degrading or altering one or more types of soil residues encountered on a surface or textile thus removing the soil or making the soil more removable by a surfactant or other component of the cleaning composition. Both degradation and alteration of soil residues can improve detergency by reducing the physicochemical forces which bind the soil to the surface or textile being cleaned, i.e. the soil becomes more water soluble. For example, one or more proteases can cleave complex, macromolecular protein structures present in soil residues into simpler short chain molecules which are, of themselves, more readily desorbed from surfaces, solubilized or otherwise more easily removed by detersive solutions containing said proteases.

Suitable enzymes may include a protease, an amylase, a lipase, a gluconase, a cellulase, a peroxidase, or a mixture thereof of any suitable origin, such as vegetable, animal, bacterial, fungal or yeast origin. Selections are influenced by factors such as pH-activity and/or stability optima, thermostability, and stability to active detergents, builders and the like. In this respect bacterial or fungal enzymes may be preferred, such as bacterial amylases and proteases, and fungal cellulases. Preferably the enzyme may be a protease, a lipase, an amylase, or a combination thereof. Enzyme may be present in the composition from at least 0.01 wt %, or 0.01 to 2 wt %.

Enzyme Stabilizing System

The composition of the invention may include an enzyme stabilizing system. The enzyme stabilizing system can include a boric acid salt, such as an alkali metal borate or amine (e. g. an alkanolamine) borate, or an alkali metal borate, or potassium borate. The enzyme stabilizing system can also include other ingredients to stabilize certain enzymes or to enhance or maintain the effect of the boric acid salt.

For example, the cleaning composition of the invention can include a water soluble source of calcium and/or magnesium ions. Calcium ions are generally more effective than magnesium ions and are preferred herein if only one type of cation is being used. Cleaning and/or stabilized enzyme cleaning compositions, especially liquids, may include 1 to 30, 2 to 20, or 8 to 12 millimoles of calcium ion per liter of finished composition, though variation is possible depending on factors including the multiplicity, type and levels of enzymes incorporated. Water-soluble calcium or magnesium salts may be employed, including for example calcium chloride, calcium hydroxide, calcium formate, calcium malate, calcium maleate, calcium hydroxide and calcium acetate; more generally, calcium sulfate or magnesium salts corresponding to the listed calcium salts may be used. Further increased levels of calcium and/or magnesium may of course be useful, for example for promoting the grease-cutting action of certain types of surfactant.

Stabilizing systems of certain cleaning compositions, for example warewashing stabilized enzyme cleaning compositions, may further include 0 to 10%, or 0.01% to 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during warewashing, can be relatively large; accordingly, enzyme stability to chlorine in-use can be problematic.

Suitable chlorine scavenger anions are known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used.

Additional Surfactants

Additional surfactants may be present in some compositions embodying the invention. The surfactant or surfactant admixture can be selected from nonionic, semi-polar nonionic, anionic, cationic, amphoteric, or zwitterionic surface-active agents; or any combination thereof. In at least some embodiments, the surfactants are water soluble or water dispersible The particular surfactant or surfactant mixture chosen for use in the process and products of this invention can depend on the conditions of final utility, including method of manufacture, physical product form, use pH, use temperature, foam control, and soil type. For a discussion of surfactants, see Kirk-Othmer, Encyclopedia of Chemical Technology, Third Edition, volume 8, pages 900–912. The composition may include a surfactant in an amount effective to provide a desired level of cleaning, such as 0–20 wt %, or 1.5–15 wt %.

Anionic surfactants may include, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like.

Nonionic surfactants may include those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkano lamine condensates, polyoxyethylene fatty acid amides, and the like; and polyalkylene oxide block copolymers including an ethylene oxide/propylene oxide block copolymer such as those commercially available under the trademark PLURONIC™ (BASF-Wyandotte), and the like; and other like nonionic compounds. Silicone surfactants such as the ABIL™ B8852 can also be used.

Cationic surfactants useful for inclusion in a cleaning composition for sanitizing or fabric softening, include amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquatemary ammonium chloride surfactants such as n-alkyl($C_{12}$–$C_{18}$)dimethylbenzyl ammonium chloride, n-tetradecyl dimethylbenzylammonium chloride monohydrate, a naphthylene-substituted quaternary ammonium chloride such as dimethyl-1-naphthylmethylammonium chloride, and the like; and other like cationic surfactants.

Chelating/Sequestering Agent

The composition may include a chelating/sequestering agent such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. The chelating/sequestering agent may also function as a threshold agent when included in an effective amount. The composition may include 0.1–70 wt %, or 5–60 wt %, of a chelating/sequestering agent. An iminodisuccinate (available commercially from Bayer as IDS™) may be used as a chelating agent.

Useful aminocarboxylic acids include, for example, N-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Examples of condensed phosphates useful in the present composition include sodium and potassium orthophosphate, sodium and potassium pyrophosphate, sodium tripolyphosphate, sodium hexametaphosphate, and the like.

The composition may include a phosphonate such as 1-hydroxyethane-1,1-diphosphonic acid and the like.

Polymeric polycarboxylates may also be included in the composition. Those suitable for use as cleaning agents have pendant carboxylate groups and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, Encyclopedia of Chemical Technology, Third Edition, volume 5, pages 339–366 and volume 23, pages 319–320, the disclosure of which is incorporated by reference herein.

Bleaching Agents

Bleaching agents for lightening or whitening a substrate, include bleaching compounds capable of liberating an active halogen species, such as $Cl_2$, $Br_2$, —$OCl^-$ and/or —$OBr^-$, under conditions typically encountered during the cleansing process. Suitable bleaching agents include, for example, chlorine-containing compounds such as a chlorine, a hypochlorite, chloramine. Halogen-releasing compounds may include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A cleaning composition may include a minor but effective amount of a bleaching agent, such as 0.1–10 wt %, or 1–6 wt %.

Detergent Builders or Fillers

A composition may include a minor but effective amount of one or more of a detergent filler which does not perform as a cleaning agent per se, but cooperates with the cleaning agent to enhance the overall cleaning capacity of the composition. Examples of fillers suitable for use in the present cleaning compositions include sodium sulfate, sodium chloride, starch, sugars, $C_1$–$C_{10}$ alkylene glycols such as propylene glycol, and the like. Inorganic or phosphate-containing detergent builders may include alkali metal, ammonium and alkanolammonium salts of polyphosphates (e.g. tripolyphosphates, pyrophosphates, and glassy polymeric meta-phosphates). Non-phosphate builders may also be used. A detergent filler may be included in an amount of 1–20 wt %, or 3–15 wt %.

Defoaming Agents

A minor but effective amount of a defoaming agent for reducing the stability of foam may also be included in the compositions. The cleaning composition can include 0.01–5 wt % of a defoaming agent, or 0.01–3 wt %.

Examples of defoaming agents include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-Redeposition Agents

The composition may include an anti-redeposition agent capable of facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. The composition may include 0.5–10 wt %, or 1–5 wt %, of an anti-redeposition agent.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as ClS-jasmine or jasmal, vanillin, and the like.

Divalent Ion

The compositions of the invention may contain a divalent ion, selected from calcium and magnesium ions, at a level of from 0.05% to 5% by weight, or from 0.1% to 1% by weight, or 0.25% by weight of the composition. The divalent ion can be, for example, calcium or magnesium. The calcium ions can, for example, be added as a chloride, hydroxide, oxide, formate, acetate, nitrate salt.

Polyol

The composition of the invention can also include a polyol. The polyol may provide additional stability and hydrotrophic properties to the composition. Propylene glycol and sorbitol are examples of some suitable polyols.

The compositions of the invention may also contain additional typically nonactive materials, with respect to cleaning properties, generally found in liquid pretreatment or detergent compositions in conventional usages. These ingredients are selected to be compatible with the materials of the invention and include such materials as fabric softeners, optical brighteners, soil suspension agents, germicides, viscosity modifiers, inorganic carriers, solidifying agents and the like.

Additional Thickening Agent

In some embodiments, it is contemplated that an additional thickening agent may be included, however, in many embodiments, it is not required. Some examples of additional thickeners include soluble organic or inorganic thickener material. Some examples of inorganic thickeners include clays, silicates and other well known inorganic thickeners. Some examples of organic thickeners include thixotropic and non-thixotropic thickeners. In some embodiments, the thickeners have some substantial proportion of water solubility to promote easy removability. Examples of useful soluble organic thickeners for the compositions of the invention comprise carboxylated vinyl polymers such as polyacrylic acids and sodium salts thereof, ethoxylated cellulose, polyacrylamide thickeners, xanthan thickeners, guargum, sodium alginate and algin by-products, hydroxy propyl cellulose, hydroxy ethyl cellulose and other similar aqueous thickeners that have some substantial proportion of water solubility.

METHODS OF MAKING

The cleaning compositions can be made by combining a sparingly water soluble surfactant, an organic solvent including an OH group, an ether group, or both an OH group and an ether group; a source of alkalinity; and a polar carrier, as each of these components are described above. In at least some embodiments, the above processes can be used to produce a product having a stable single solution phase. The compositions can be diluted with aqueous and/or non aqueous materials to form a use solution of any strength and viscosity depending on the application. The compositions of the invention may be in the form of a solid, liquid, gel, paste, structured liquid, and the like. The compositions and diluted use solutions may be useful as, for example, as surface cleaners, detergents for laundry, warewashing, vehicle care, sanitizing, ect. (grease remover).

The thickness or viscosity of the cleaning composition can be tailored by varying the amount of the thickening medium components, or possibly other additional thickeners within the composition. In some embodiments, the composition can have viscosities in the range of about 10 to about 2000, in the range of about 25 to 1500, or in the range of about 50 to 1000.

Additionally, it is also contemplated that a thickening medium alone can be made by combining the sparingly water soluble surfactant, and the organic solvent including an OH group, an ether group, or both an OH group and an ether group. Thereafter, the thickening medium can be added to an appropriate cleaning composition, as described above.

EXAMPLES

Two formulations were created by combining the components in the amounts listed in the Tables 1 and 2 below.

The formulation 1 shown in Table 1 includes a base composition including linear dodecyl benzene sulfonic acid as a sparingly water soluble surfactant, and ethylene glycol monobutyl ether as organic solvent including an OH group and an ether group. NaOH is included as a source of alkalinity, and water is included as a polar carrier. Sodium lauryl ether sulfate, and lauryl dimethylamine oxide are included as additional functional ingredients, and pylaklor alkali purple LX 10695 is included as a dye. The composition had a viscosity of about 540 cps.

TABLE 1

(Formulation 1)

| Component | Wt % |
|---|---|
| linear dodecyl benzene sulfonic acid, 97%[1] | 5 |
| ethylene glycol monobutyl ether[2] | 4.4 |
| NaOH | 10 |
| Soft Water | 76.1 |

TABLE 1-continued

| (Formulation 1) | |
|---|---|
| Component | Wt % |
| sodium lauryl ether sulfate, 60%[3] | 1 |
| lauryl dimethylamine oxide[4] | 3.5 |
| pylaklor alkali purple LX 10695[5] | 0.004 |

[1]A product name BioSoft 100 commercially available from Stepan Company was used for this example, but other sources may be available.
[2]A product named Butyl CELLSOLVE solvent commercially available from Dow Chemical company was used was used for this example, but other sources may be available.
[3]A product named Sulfotex 6040S commercially available from Stepan Company was used for this example, but other sources may be available.
[4]A product named Barlox 12 commercially available from Goldschmidt AG was used for this example, but other sources may be available.
[5]A dye, commerically available from Pylan Dyes Inc. was used for this example, but other dyes or sources of dyes may be available.

Formulation 2, shown in Table 2, includes a base composition including ethylene glycol monobutyl ether as organic solvent including an OH group and an ether group, NaOH as a source of alkalinity, and water as a polar carrier. Lauryl dimethylamine oxide is included as an additional functional ingredient, and pylaklor alkali purple LX 10695 is included as a dye. The composition had a viscosity of about 60 cps.

TABLE 2

| (Formulation 2) | |
|---|---|
| Component | Wt % |
| ethylene glycol monobutyl ether | 4.6 |
| NaOH | 10 |
| Soft Water | 80.4 |
| lauryl dimethylamine oxide | 5 |
| pylaklor alkali purple LX 10695 | 0.004 |

The composition of Formula 1 had good oil/grease cleaning characteristics, and provides the necessary physical properties, such as viscosity, for the good cleaning performance. Formulation 2 does cut grease, but does not include the viscosity needed for good contact time and optimum cleaning.

The cleaning properties of Formulation 1 was then compared with the cleaning properties of a commercially available grease cleaner named GreaseStrip, commercially available from Ecolab Inc. The GreaseStrip product is thickened using a xanthan gum thickener commercially available under the name Kelzan from CP Kelco Company.

During this experiment, six stainless steel coupons were cleaned and weighted prior to coating them with oil. The coupons were then coated with corn oil, and then heated in a curing oven at 400° F. for five hours, or until the oil had carbonized onto the coupons, and was no longer oily. The coupons were then removed from the curing oven and weighed again to determine the added weight of the baked on oil. Three coupons were then immersed in a cleaning composition in accordance with Formulation 1 above, and the remaining three coupons were coupons were immersed in the xanthan gum thickened GreaseStrip product. The coupons were allowed to remain immersed in the cleaning compositions for five hours, and were then removed, rinsed, and allowed to dry. Once dried, the coupons were again reweighed to determine the percent grease removal. The results are shown in Table 3 below.

| Cleaning Formulation Used | Weight of Clean Coupon | Weight of Soiled Coupon | Weight of Coupon after Immersion | Percent Removal of Soil |
|---|---|---|---|---|
| Formula 1 | 23.23 | 23.37 | 23.30 | 50.00 |
| Formula 1 | 23.19 | 23.34 | 23.25 | 60.00 |
| Formula 1 | 23.13 | 23.25 | 23.18 | 58.33 |
| Xanthan gum thickened GreaseStrip | 22.36 | 22.55 | 22.49 | 31.58 |
| Xanthan gum thickened GreaseStrip | 22.30 | 22.50 | 22.44 | 30.00 |
| Xanthan gum thickened GreaseStrip | 23.21 | 23.34 | 23.31 | 23.08 |

As can be seen from the results, the composition of Formula 1 outperformed the Xanthan gum thickened GreaseStrip formulation in soil removal in this example.

An additional formulation, Formulation 3, was created by combining the components in the amounts listed in Tables 3 below. The resulting composition had a viscosity of about 580 cps.

TABLE 3

| (Formulation 3) | |
|---|---|
| Component | Wt % |
| linear dodecyl benzene sulfonic acid, 97%[1] | 5 |
| Propylene glycol n-propyl ether[2] | 4.6 |
| NaOH | 10 |
| Soft Water | 75.9 |
| sodium lauryl ether sulfate, 60%[3] | 1 |
| lauryl dimethylamine oxide[4] | 3.5 |
| pylaklor alkali purple LX 10695[5] | 0.004 |

[1]A product named BioSoft 100 commercially available from Stepan Company was used for this example, but other sources may be available.
[2]A product named Dowanol PnP glycol ether solvent commercially available from Dow Chemical company was used for this example, but other sources may be available..
[3]A product named Sulfotex 6040S commercially available from Stepan Company was used for this example, but other sources may be available.
[4]A product named Barlox 12 commercially available from Goldschmidt AG was used for this example, but other sources may be available.
[5]A dye, commercially available from Pylam Dyes Inc. was used for this example, but other dyes or sources of dyes may be available.

The composition of Formulation 3 also had good oil/grease cleaning characteristics, and provided the necessary physical properties, such as viscosity, for the good cleaning performance.

An additional formulation, Formulation 4, was created by combining the components in the amounts listed in Tables 4 below. The resulting composition had a viscosity of about 990 cps.

TABLE 4

| (Formulation 4) | |
|---|---|
| Component | Wt % |
| linear dodecyl benzene sulfonic acid, 97%[1] | 7.5 |

TABLE 4-continued (Formulation 4)

| Component | Wt % |
|---|---|
| Propylene glycol n-propyl ether[2] | 4.6 |
| NaOH | 12.5 |
| Soft Water | 70.9 |
| sodium lauryl ether sulfate, 60%[3] | 1 |
| lauryl dimethylamine oxide[4] | 3.5 |
| pylaklor alkali purple LX 10695[5] | 0.004 |

[1]A product named BioSoft 100 commercially available from Stepan Company was used for this example, but other sources may be available.
[2]A product named Dowanol PnP glycol ether solvent commercially available from Dow Chemical company was used for this example, but other sources may be available..
[3]A product named Sulfotex 6040S commercially available from Stepan Company was used for this example, but other sources may be available.
[4]A product named Barlox 12 commercially available from Goldschmidt AG was used for this example, but other sources may be available.
[5]A dye, commercially available from Pylam Dyes Inc. was used for this example, but other dyes or sources of dyes may be available.

The composition of Formulation 4 also had good oil/grease cleaning characteristics, and provided the necessary physical properties, such as viscosity, for the good cleaning performance.

An additional formulation, Formulation 5, was created by combining the components in the amounts listed in Tables 5 below. The resulting composition had a viscosity of about 660 cps.

TABLE 5

(Formulation 5)

| Component | Wt % |
|---|---|
| linear dodecyl benzene sulfonic acid, 97%[1] | 6 |
| Propylene glycol n-propyl ether[2] | 4.6 |
| NaOH | 11 |
| Soft Water | 73.9 |
| sodium lauryl ether sulfate, 60%[3] | 1 |
| lauryl dimethylamine oxide[4] | 3.5 |
| pylaklor alkali purple LX 10695[5] | 0.004 |

[1]A product named BioSoft 100 commercially available from Stepan Company was used for this example, but other sources may be available.
[2]A product named Dowanol PnP glycol ether solvent commercially available from Dow Chemical company was used for this example, but other sources may be available..
[3]A product named Sulfotex 6040S commercially available from Stepan Company was used for this example, but other sources may be available.
[4]A product named Barlox 12 commercially available from Goldschmidt AG was used for this example, but other sources may be available.
[5]A dye, commercially available from Pylam Dyes Inc. was used for this example, but other dyes or sources of dyes may be available.

The composition of Formulation 5 also had good oil/grease cleaning characteristics, and provided the necessary physical properties, such as viscosity, for the good cleaning performance.

As can be seen from a comparison of Formulations 3, 4 and 5, the viscosity of a particular formulation can be varied, for example, by varying the amount of sparingly water soluble surfactant component within the composition.

Those skilled in the art will recognize that the present invention may be manifested in a variety of forms other than the specific embodiments described and contemplated herein. Accordingly, departures in form and detail may be made without departing from the scope and spirit of the present invention as described in the appended claims.

We claim:

1. An alkali cleaning composition comprising:

0.5–20 weight percent of a sparingly water soluble surfactant comprising a linear or branched, substituted or unsubstituted alkyl benzene sulfonate, or a derivative thereof, the sparingly water soluble surfactant having water, solubility in the range of about 0.01 to about 15 weight percent in water;

1–20 weight percent of an organic solvent comprising a water soluble glycol ether;

1–40 weight percent of an alkali metal hydroxide or an alkaline earth metal hydroxide as an alkalinity source, wherein the alkalinity source is present in a molar excess with respect to the sparingly water soluble surfactant; and a polar carrier;

wherein the cleaning composition is a liquid and the combination of sparingly water soluble surfactant, organic solvent, alkalinity source, and polar carrier interact to thicken the composition and provide the composition with a viscosity in the range of about 200 to about 1000 centipoise without inclusion of additional thickening agents.

2. The cleaning composition of claim 1, wherein the polar carrier comprises water.

3. The cleaning composition of claim 1, wherein the organic solvent has an HLB value in the range of about 7 to about 8.

4. The cleaning composition of claim 1, wherein the organic solvent comprises a propylene glycol ether or an ethylene glycol ether.

5. The cleaning composition of claim 4, wherein the organic solvent comprises di propylene glycol-n-butyl ether, propylene glycol-n-butyl ether, tri propylene glycol-n-propyl ether, di propylene glycol-n-propyl ether, propylene glycol-n-propyl ether, ethylene glycol-n-butyl ether, di ethylene glycol-n-butyl ether, or mixtures or derivatives thereof.

6. The cleaning composition of claim 5, wherein the organic solvent comprises di propylene glycol-n-propyl ether, propylene glycol-n-propyl ether, ethylene glycol-n-butyl ether, di ethylene glycol-n-butyl ether, or mixtures or derivatives thereof.

7. The cleaning composition of claim 1, wherein the organic solvent comprises ethylene glycol-n-butyl ether.

8. The cleaning composition of claim 1, wherein the sparingly water soluble surfactant comprises a linear alkyl benzene sulfonate.

9. The cleaning composition of claim 8, wherein the linear alkyl portion of the linear alkyl benzene sulfonate includes in the range of 4 and 18 carbon atoms.

10. The cleaning composition of claim 1, wherein the sparingly water soluble surfactant comprises linear dodecyl benzene sulfonic acid.

11. The cleaning composition of claim 1, wherein the sparingly water soluble surfactant comprises a branched alkyl benzene sulfonate.

12. The cleaning composition of claim 11, wherein the branched alkyl portion of the branched alkyl benzene sulfonate includes in the range of 4 and 18 carbon atoms.

13. The cleaning composition of claim 1, wherein the sparingly water soluble surfactant comprises a linear or branched, substituted or unsubstituted alkyl benzene sulfonate including a cationic portion that includes an alkali metal ion or an alkali earth metal ion.

14. The cleaning composition of claim 1, wherein the sparingly water soluble surfactant comprises a compound of the formula:

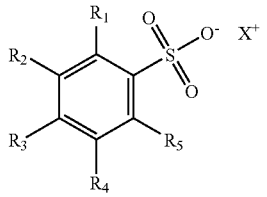

wherein $R_1$–$R_5$ are the same or different, and are each independently hydrogen, or $C_1$ through $C_{18}$ linear or branched, unsubstituted or substituted alkyl; and $X^+$ is a cation.

15. The cleaning composition of claim 14, wherein $R_1$, $R_2$, $R_4$ and $R_5$ are hydrogen, and $R_3$ is a linear or branched, unsubstituted or substituted alkyl having in the range of 1 and 18 carbon atoms.

16. The cleaning composition of claim 1, further comprising one or more additional functional ingredients.

17. The cleaning composition of claim 16, wherein the one or more additional functional ingredients comprise an enzyme, an enzyme stabilizing system, an additional surfactant, a chelating agent, a sequestering agent, a bleaching agent, a solubility modifier, a detergent filler, a defoamer, an anti-redeposition agent, a threshold agent or system, an aesthetic enhancing agent, or combinations or mixtures thereof.

18. A method of producing an alkali cleaning composition, the method comprising:

admixing the following ingredients:

0.5–20 weight percent of a sparingly water soluble surfactant comprising a linear or branched, substituted or unsubstituted alkyl benzene sulfonate, or a derivative thereof, the sparingly water soluble surfactant having water solubility in the range of about 0.01 to about 15 weight percent in water;

1–20 weight percent of an organic solvent comprising a water soluble glycol ether;

1–40 weight percent of an alkali metal hydroxide or an alkaline earth metal hydroxide as an alkalinity source, wherein the alkalinity source is present in a molar excess with respect to the sparingly water soluble surfactant; and a polar carrier;

wherein the cleaning composition is a liquid and the combination of sparingly water soluble surfactant, organic solvent, alkalinity source, and polar carrier interact to thicken the composition and provide the composition with a viscosity in the range of about 200 to about 1000 centipoise without inclusion of additional thickening agents.

19. A cleaning composition produced according the method of claim 18.

20. The method of claim 18, wherein the polar carrier comprises water.

21. The method of claim 18, wherein the organic solvent has an HLB value in the range of about 7 to about 8.

22. The method of claim 18, wherein the organic solvent comprises a propylene glycol ether or an ethylene glycol ether.

23. The method of claim 18, wherein the organic solvent comprises di propylene glycol-n-butyl ether, propylene glycol-n-butyl ether, tri propylene glycol-n-propyl ether, di propylene glycol-n-propyl ether, propylene glycol-n-propyl ether, ethylene glycol-n-butyl ether, di ethylene glycol-n-butyl ether, benzyl alcohol, or mixtures or derivatives thereof.

24. The method of claim 18, wherein the sparingly water soluble surfactant comprises a linear alkyl benzene sulfonate, and wherein the linear alkyl portion of the linear alkyl benzene sulfonate includes in the range of 4 and 18 carbon atoms.

25. The method of claim 18, wherein the sparingly water soluble surfactant comprises linear dodecyl benzene sulfonic acid.

26. The method of claim 18, wherein the sparingly water soluble surfactant comprises a linear or branched, substituted or unsubstituted alkyl benzene sulfonate including a cationic portion that includes an alkali metal ion or an alkali earth metal ion.

27. The method of claim 18, wherein the sparingly water soluble surfactant comprises compound of the formula:

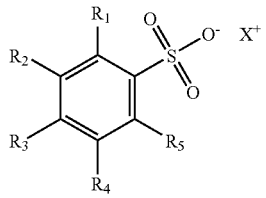

wherein $R_1$–$R_5$ are the same or different, and are each independently hydrogen, or $C_1$ through $C_{18}$ linear or branched, unsubstituted or substituted alkyl; and $X^+$ is a cation.

28. The method of claim 18, wherein the cleaning composition further comprises one or more additional functional ingredients.

* * * * *

UNITED STATES PATENT AND TRADEMARK OFFICE

CERTIFICATE OF CORRECTION

PATENT NO. : 7,071,155 B2
APPLICATION NO. : 10/263414
DATED : July 4, 2006
INVENTOR(S) : Greg G. Griese et al.

It is certified that error appears in the above-identified patent and that said Letters Patent is hereby corrected as shown below:

Column 15

Footnote 2 - Line 12, delete “CELLSOLVE”, and insert therefor -- CELLOSOLVE --.

Footnote 5 - Line 19, delete “commerically”, and insert therefor -- commercially --.

Footnote 5 - Line 19, delete “Pylan”, and insert therefor -- Pylam --.

Signed and Sealed this

Tenth Day of October, 2006

JON W. DUDAS
*Director of the United States Patent and Trademark Office*